US007104200B2

(12) United States Patent
Hosking et al.

(10) Patent No.: US 7,104,200 B2
(45) Date of Patent: Sep. 12, 2006

(54) RAIL FASTENER DRIVER WITH ENHANCED FASTENER POSITIONING

(75) Inventors: Jack K. Hosking, Waukesha, WI (US); Robert C. Claas, Saukville, WI (US); James W. Fuerst, Wauwatosa, WI (US)

(73) Assignee: Nordco Inc., Oak Creek, WI (US)

( * ) Notice: Subject to any disclaimer, the term of this patent is extended or adjusted under 35 U.S.C. 154(b) by 267 days.

(21) Appl. No.: 10/689,452

(22) Filed: Oct. 20, 2003

(65) Prior Publication Data

US 2005/0081735 A1 Apr. 21, 2005

(51) Int. Cl.
*E01B 29/00* (2006.01)

(52) U.S. Cl. ..... 104/17.2

(58) Field of Classification Search ..... 104/17.1, 104/17.2, 307, 2; 81/57.37, 431; 227/107, 227/113, 117, 137, 139; 173/184, 185, 92; 414/779

See application file for complete search history.

(56) References Cited

U.S. PATENT DOCUMENTS 4,273,052 A * 6/1981 Woolner et al. ..... 104/17.1
4,579,061 A 4/1986 Dieringer
4,777,885 A 10/1988 Dieringer
5,191,840 A 3/1993 Cotic et al.
5,542,355 A 8/1996 Madison et al.
5,671,679 A 9/1997 Straub et al.

* cited by examiner

*Primary Examiner*—Mark T. Le
(74) *Attorney, Agent, or Firm*—Greer, Burns & Crain, Ltd.

(57) ABSTRACT

A rail fastener driver apparatus for driving fasteners into ties of a railroad track includes a fastener driving mechanism with a reciprocating element for engaging a fastener and driving it into a tie, a fastener magazine configured for accommodating a plurality of rail fasteners and feeding them sequentially for driving by the element, a fastener feeder mechanism including a fastener holder configured for movement between a first position sequentially receiving one fastener from the magazine and a second position placing the fastener in a driving position for engagement by the driving element and the fastener feeder mechanism configured for lowering and axially rotating the fastener from the first position to the second position. An obstacle accommodation device, and a method of driving rail fasteners are also provided.

17 Claims, 6 Drawing Sheets

RAIL FASTENER DRIVER WITH ENHANCED FASTENER POSITIONING

BACKGROUND OF THE INVENTION

The present invention relates generally to railroad right-of-way maintenance machinery, and specifically to machinery used for driving fasteners into rail ties for securing rail tie plates and rails to the ties.

Rail fasteners as contemplated herein include cut spikes, lag screws, hairpin spikes and other types of rail fasteners used for retaining tie plates upon ties, and rails upon tie plates, as are known to skilled practitioners. In some cases in the specification, "spikes" may be used interchangeably with "rail fasteners". The use of the term "spikes" is not intended to limit the scope of the present invention.

During the course of railroad maintenance work, it is common that existing rail fasteners are removed for replacement of rail ties, tie plates, rails and for other maintenance operations. Once the desired maintenance is complete, the fasteners need to be reinstalled. Several types of rail fastener applicators or drivers are known, and suitable models are described in commonly assigned U.S. Pat. Nos. 4,579,061; 4,777,885; 5,191,840 and 5,671,679, all of which are incorporated by reference herein, and all of which are assigned to Nordco Inc. of Milwaukee, Wis.

Such rail fastener driving machines typically include a frame which is either self-propelled or towable along the track, a rail fastener driving apparatus with a fastener driving mechanism such as a fluid power cylinder provided with a reciprocating element for impacting a fastener and driving it into a tie, a fastener magazine configured for accommodating a plurality of rail fasteners and feeding them sequentially for driving by the element, a fastener feeder mechanism configured for conveying fasteners sequentially from the magazine to a location in operational relationship to the driving element.

Such devices typically have a travel position, where the fastener feeder mechanism is held sufficiently above the track to avoid damage by obstacles including the track itself. In addition, during operation, the units typically move between a first or fastener loading position, and a fastener driving position. It is important, for maintaining desired productivity rates, that the latter two positions are closer to the track. To avoid damage to the mechanisms, such units are designed for operation so that either travel is prohibited when these mechanisms are in the latter two positions, or the mechanisms automatically rise to the travel position when the unit begins to move to the next location.

While protecting the typically complicated rail fastener handling and driving mechanisms, this operational precautions tend to limit productivity as measured by the rate of fastener-driving by a particular unit.

Thus, there is a need for a rail fastener driving mechanism which enables greater fastener driving productivity while protecting the fastener driving mechanisms.

There is also a need for a rail fastener driving mechanism which is configured so that the unit can be transported along the track with the fastener driving mechanism in a position closer to the track for more rapid fastener driving and greater productivity.

BRIEF SUMMARY OF THE INVENTION

The above-listed needs are met or exceeded by the present rail fastener driving apparatus with enhanced fastener positioning which overcomes the limitations of the current technology. The present apparatus features the ability to maintain the fastener feeding assembly closer to the track while the unit moves from one operational position to another. This feature is embodied in an obstruction accommodation mechanism which allows the fastener holding portion to pivot upwardly upon contact with obstructions, including portions of the track itself. Another feature of the present rail fastener driving apparatus is that the fastener feeder mechanism pivots and lowers the fastener toward the fastener driving element or hammer. This reduces fastener driving cycle time, in that the fastener is more rapidly placed in operational position for driving. As the fastener is lowered, it is properly oriented.

More specifically, the present invention includes a rail fastener driving apparatus for driving fasteners into ties of a railroad track. The apparatus includes a fastener driving mechanism with a reciprocating element for engaging a fastener and driving it into a tie, a fastener magazine configured for accommodating a plurality of rail fasteners and feeding them sequentially for driving by the element, a fastener feeder mechanism including a fastener holder configured for movement between a first position sequentially receiving one fastener from the magazine and a second position placing the fastener in a driving position for engagement by the driving element. The fastener feeder mechanism is configured for lowering and axially rotating the fastener from the first position to the second position.

In a preferred embodiment, the lowering and axial rotation occurs simultaneously. In another embodiment, a rail fastener driving apparatus as described above is provided wherein the fastener holder is configured for biased, pivotal movement relative to the feeder mechanism for accommodating obstacles encountered while the machine travels upon the track.

In still another embodiment, a method of driving rail fasteners into tie plates and ties of a railroad track, includes providing a rail fastener driving apparatus with a fastener driving mechanism and having a reciprocating element for impacting a fastener and driving it into a tie, a fastener magazine configured for accommodating a plurality of rail fasteners and feeding them sequentially for driving by the element, a fastener feeder mechanism including a fastener holder configured for movement between a first position receiving at least one fastener from the magazine and a second position placing the at least one fastener in a driving position for engagement by the driving element, the fastener holder being pivotally biased relative to the feeder mechanism for accommodating obstacles encountered while traveling along the track in the first position. Next, driving with the driving element a fastener supplied by the magazine to the fastener holder, retracting the driving element and the feed mechanism to the first position, one of loading another fastener into the fastener holder and moving the apparatus along the track, the other of loading another fastener into the fastener holder and moving the apparatus along the track, moving the fastener holder with a fastener to the second position for engagement by the driving element, stopping the apparatus on the track, finding a hole suitable for driving a fastener, and driving the fastener in the fastener holder using the driving element.

DETAILED DESCRIPTION OF THE INVENTION

Figure 1:
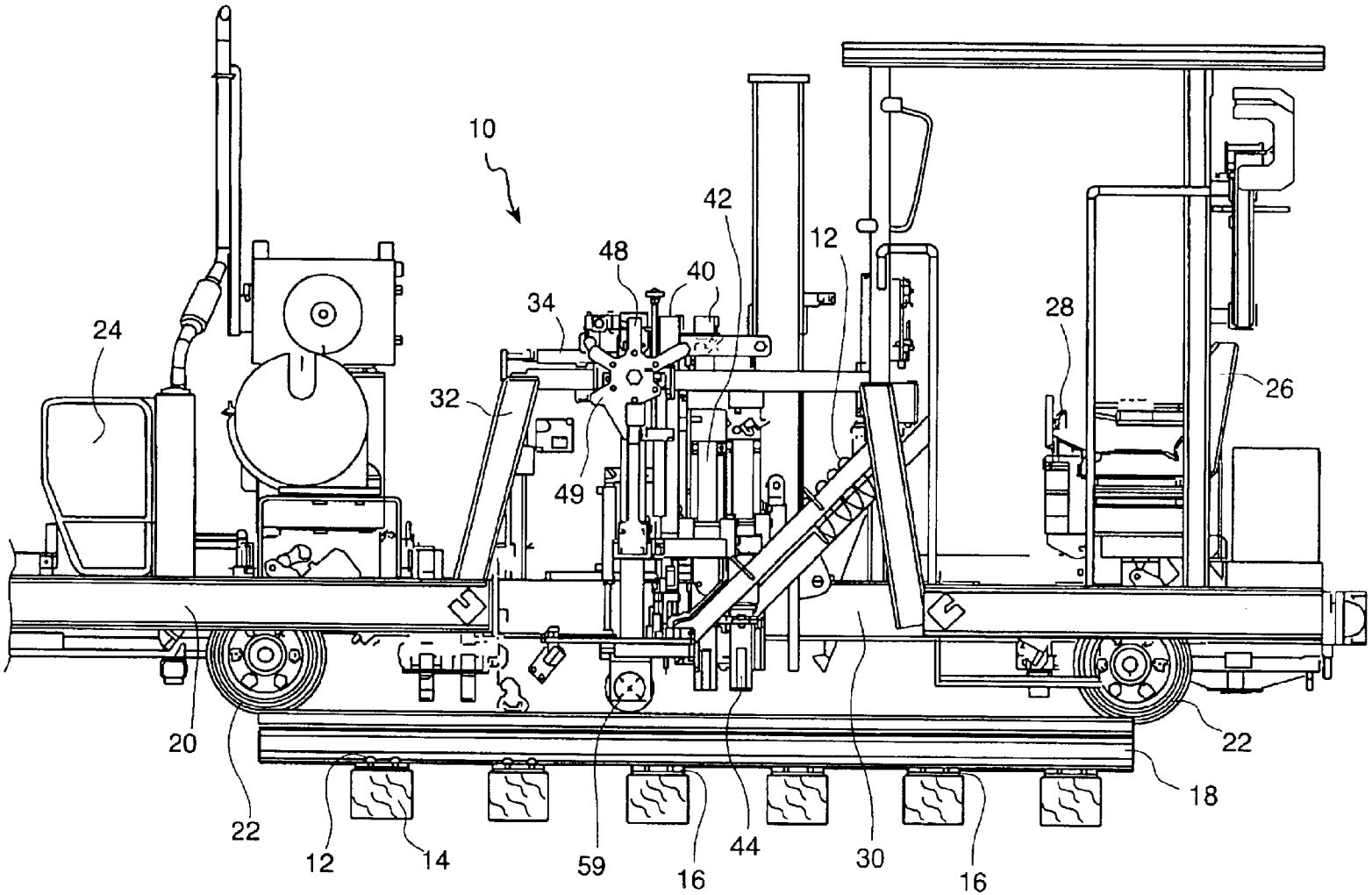
FIG. 1 is a side elevation of a rail fastener driving machine incorporating the present invention.

Referring now to FIG. 1, a rail fastener driving machine suitable for use with or incorporating the present invention is generally designated 10 and is designed for driving rail fasteners 12 into railroad ties 14 to secure rail tie plates 16 and usually a pair of rails 18 to the ties. The fasteners 12, the ties 14, the tie plates 16 and the rails 18 are often collectively referred to as the railroad track. Included on the machine 10 is a frame 20 supported on wheels 22 such that the frame is movable along the track, either by being self-propelled by a source of motive power 24 such as an engine, or by being towable by another powered vehicle, as is well known in the art.

At least one operator's seat 26 is disposed on the frame 20 in operational relationship to a control system embodied by a joystick 28 or equivalent operator input system having at least one trigger, switch, button or other input mechanism.

A work area or operational zone 30 is defined by the frame 20 as a recess, one such recess is preferably formed on each side of the frame corresponding to one of the two rails 18 of the track. Additional structural support is provided by an elevated superstructure 32, which is the mounting point for a spotting carriage 34. As is known in the art, the spotting carriage 34 includes a series of shafts and fluid power cylinders used to selectively position operational units vertically, parallel and transverse to the rails 18 over portions of the track needing maintenance. While other arrangements are contemplated, a shaft 34*a* having an associated cylinder (not shown) controls movement parallel to the rail 18 (forward and back), a cylinder 34*b* controls movement transverse to the rail (left to right) and cylinder 34*c* controls vertical movement of the operational unit relative to the rail. It will be appreciated that extension and retraction of the cylinder 34*b* causes pivoting action about the shaft 34*a*. Also, the frame 20 is preferably provided with at least tie nipper (not shown) for pulling the tie 14 tight to the rail 18 for application of the fastener.

Figure 2:
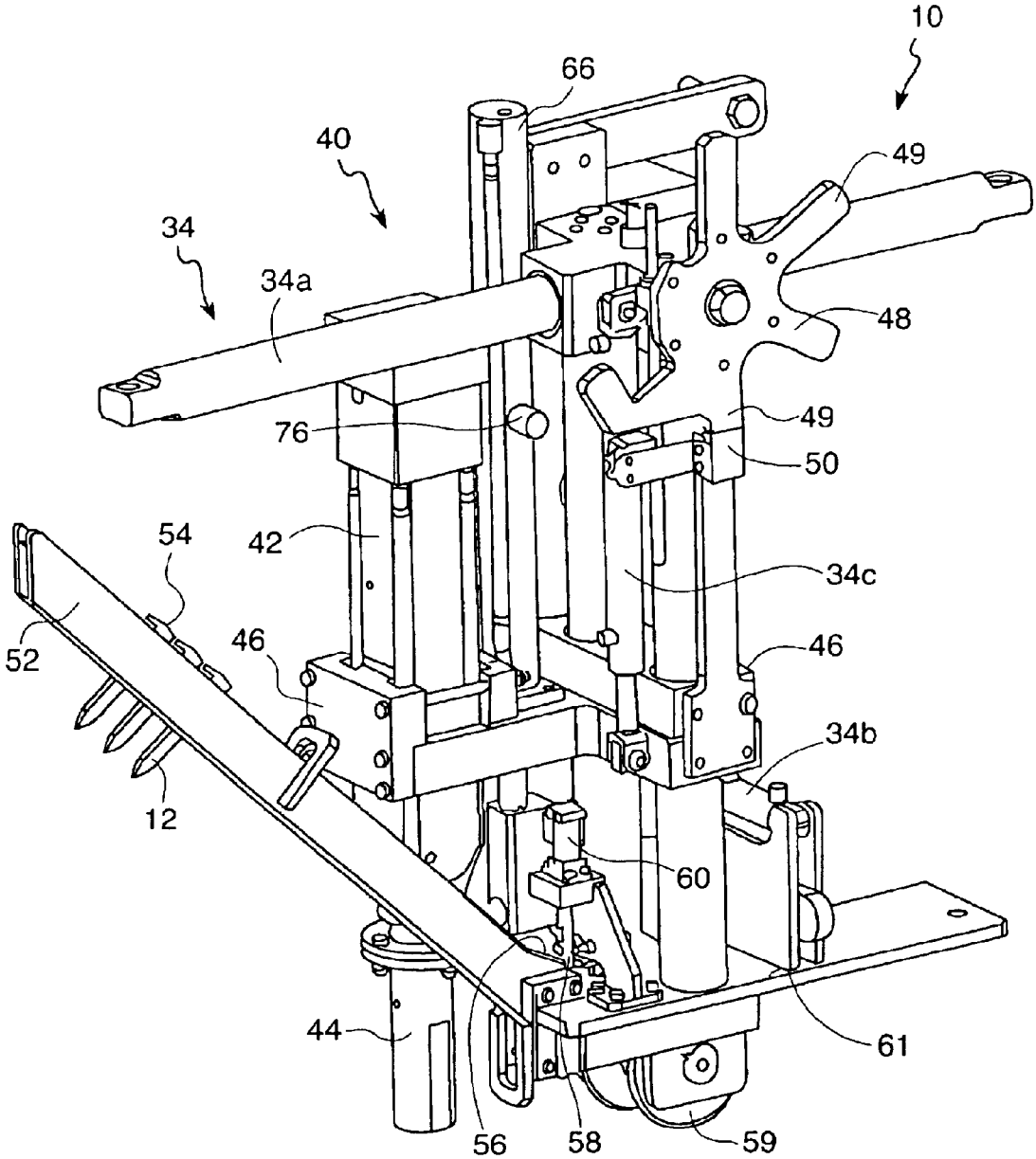
FIG. 2 is a fragmentary top perspective of the present rail fastener driving apparatus.
Figure 3:
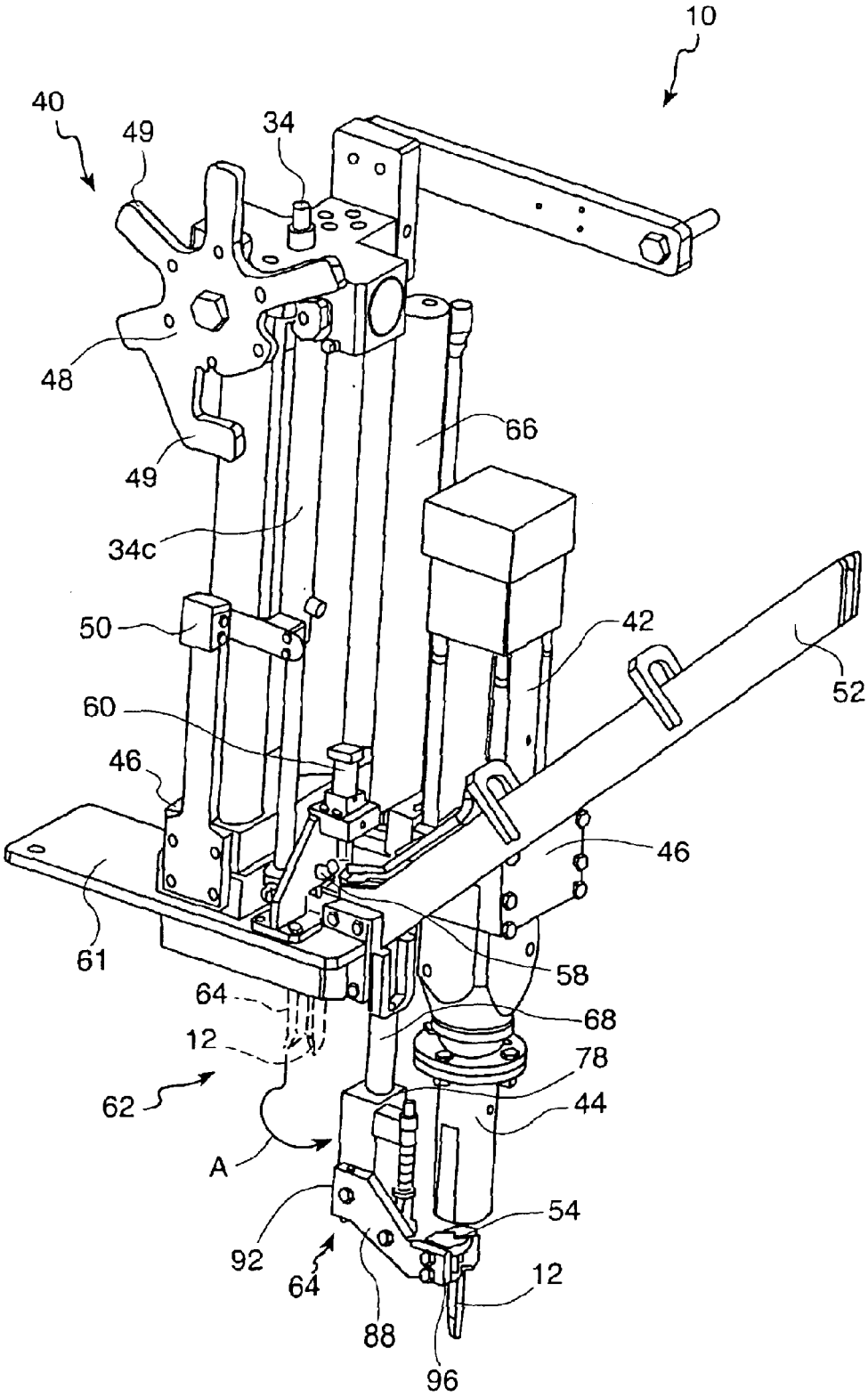
FIG. 3 is a reverse fragmentary top perspective of the apparatus shown in FIG. 2.

Referring now to FIGS. 1–3, in the present fastener driving machine 10, each of the preferably two work areas 30 is provided with at least one and preferably two fastener driving units 40 which are also referred to as spiker guns. Only one such unit 40 will be described in detail, since the units are preferably identical or substantially identical to each other. A main component of each fastener driving unit 40 is a fluid power or preferably hydraulic cylinder 42 with a reciprocating element, here a piston shaft or ram 44 configured for engaging the head of the fastener 12 and driving it into a selected tie 14. There are two generally accepted types of cylinders 42 used in this application, the so-called "push" type, where the fluid pressure is gradually and progressively applied to the fastener 12, and the "percussive" type, where fluid pressure is applied in a pulsing fashion. In the present machine 10, it is preferred that the cylinder 42 is the percussive type, and is very similar to conventional hydraulic impact hammers used for breaking up concrete or asphalt pavement. A suitable hammer is designed to deliver 200 ft. lbs. of impact energy at a rate of 450–1200 blows per minute. The cylinder 42 is mounted in a hammer bracket 46 which in turn is connected to the spotting carriage 34 so that the cylinder can be moved to a desired location under operator control. As is known in the art, the cylinder 42 may be reciprocally moved vertically relative to the spotting carriage 34, which is then movable in at least two generally horizontal directions, parallel and transverse to the rails 18.

A rotating star wheel 48 is provided in operational relationship to the spotting carriage 34 and operates with a stop 50 fixed to the bracket 46 to precisely adjust the relative uppermost vertical position of the cylinder 42. The star wheel 48 includes a plurality of variable length protrusions 49. Depending on the rotational position of the star wheel 48 (under operator control), the uppermost vertical position of the cylinder 42, as well as the associate fastener 12 may be changed to accommodate variations in rail height.

Also included in each fastener driving unit 40 is a fastener magazine 52 configured for accommodating a plurality of the rail fasteners 12 and feeding them sequentially for driving by the ram 44. While other orientations are contemplated, the present fastener magazine is configured for accommodating the fasteners 12 in an arrangement such that the typically somewhat offset and elongate heads 54 are oriented in the direction of the rails 18 (best seen in FIG. 2). The magazine 52 is basically an inclined, elongate chute made of a pair of parallel bars which guide the fasteners toward a delivery point 56. In the preferred embodiment, the magazine 52 is inclined so that the fasteners 12 move toward the delivery point 56 by gravity. At the delivery point 56, an escapement pin 58 powered by a fluid power cylinder 60 selectively permits the delivery of one fastener 12 at a time under operator control. The magazine 52, the escapement pin 58 and the cylinder 60 are all supported on the fastener driving unit 40, preferably by a lower bracket 61. A guide wheel 59 is pivotably secured to the unit 40 and engages the corresponding rail 18 to properly align the unit 40 during operation.

Figure 4:
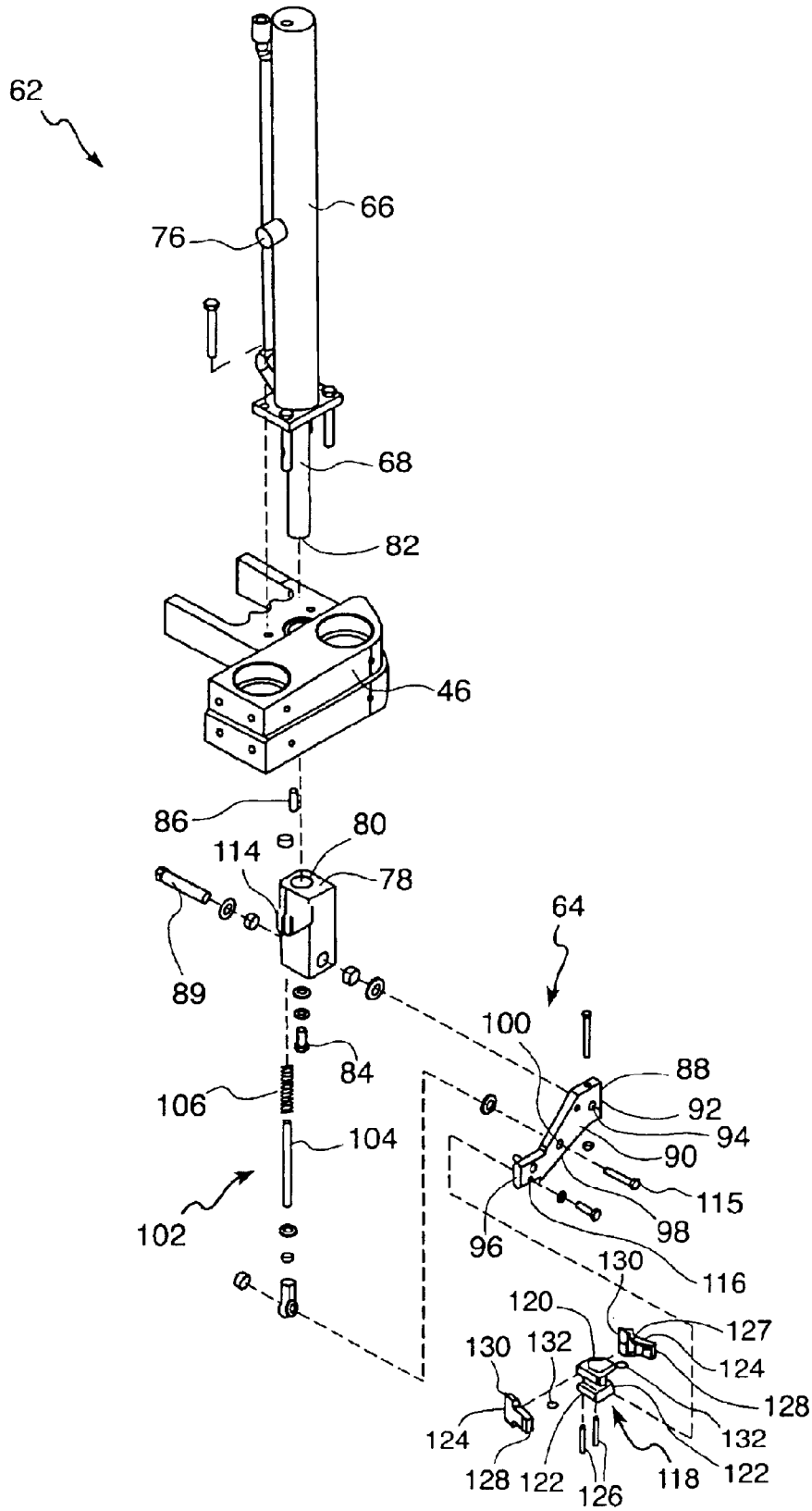
FIG. 4 is an exploded perspective view of the rail fastener driving apparatus of FIG. 2.

Referring now to FIGS. 3 and 4, a fastener feeder mechanism is generally designated 62 and includes a fastener holder 64 configured for movement between a first position (fragmentarily shown in phantom in FIG. 3) sequentially receiving a fastener 12 from the magazine 52 and a second position (shown in solid lines in FIG. 3) placing the fastener 12 in a driving position for engagement by the ram 44 for driving. An important feature of the present fastener driving unit 40 is that the fastener feeder mechanism 62 is configured for lowering and axially rotating each fastener 12 from the first position to the second position. Preferably, the vertical (lowering) movement component and the axially rotating movement component are performed in close temporal succession, and even more preferably, these movements occur simultaneously, as indicated by the arrow A in FIG. 3 and as will be described below.

Figure 5:
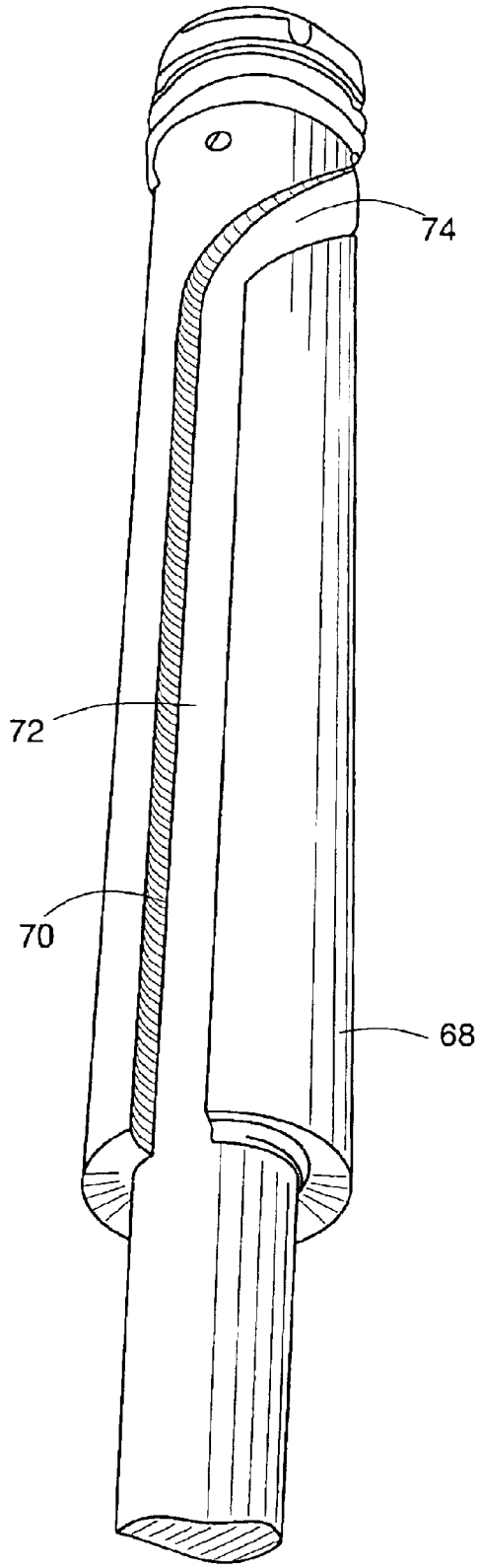
FIG. 5 is a fragmentary perspective view of the grooved shaft of the cylinder used for moving the fastener holding assembly from a first position to a second position.

Referring now to FIGS. 3, 4 and 5, the fastener feeder mechanism 62 includes a fluid power feeder cylinder 66 having a shaft 68 with a groove 70 configured for rotating while reciprocating. More specifically, the groove 70 includes an elongate, generally axial portion 72 for effecting vertical movement, and a semi-helical component 74 for effecting axial rotation. As seen in FIG. 5, the shaft 68 may be radially thickened along its length to accommodate and support the groove 70 while maintaining structural strength.

The groove 70 is slidably and matingly engaged by a cam follower 76 (FIGS. 2 and 4) in the cylinder 66 to provide the desired movement. In the preferred embodiment, the semi-helical component 74 of the shaft 68 is configured to rotate approximately 90° between a retracted position and an extended position. This preferred 90° rotation not only moves the fastener 12 from the delivery point 56 to the location of the ram 44, it also axially rotates the fastener 90° so that, upon driving, the head 54 will be oriented approximately transverse to the direction of the rail 18, as is standard in the industry. Thus, once the feeder cylinder 66 is energized, the fastener holder 64 is simultaneously lowered and axially rotated to move the fastener 12 as just described.

Figure 6:
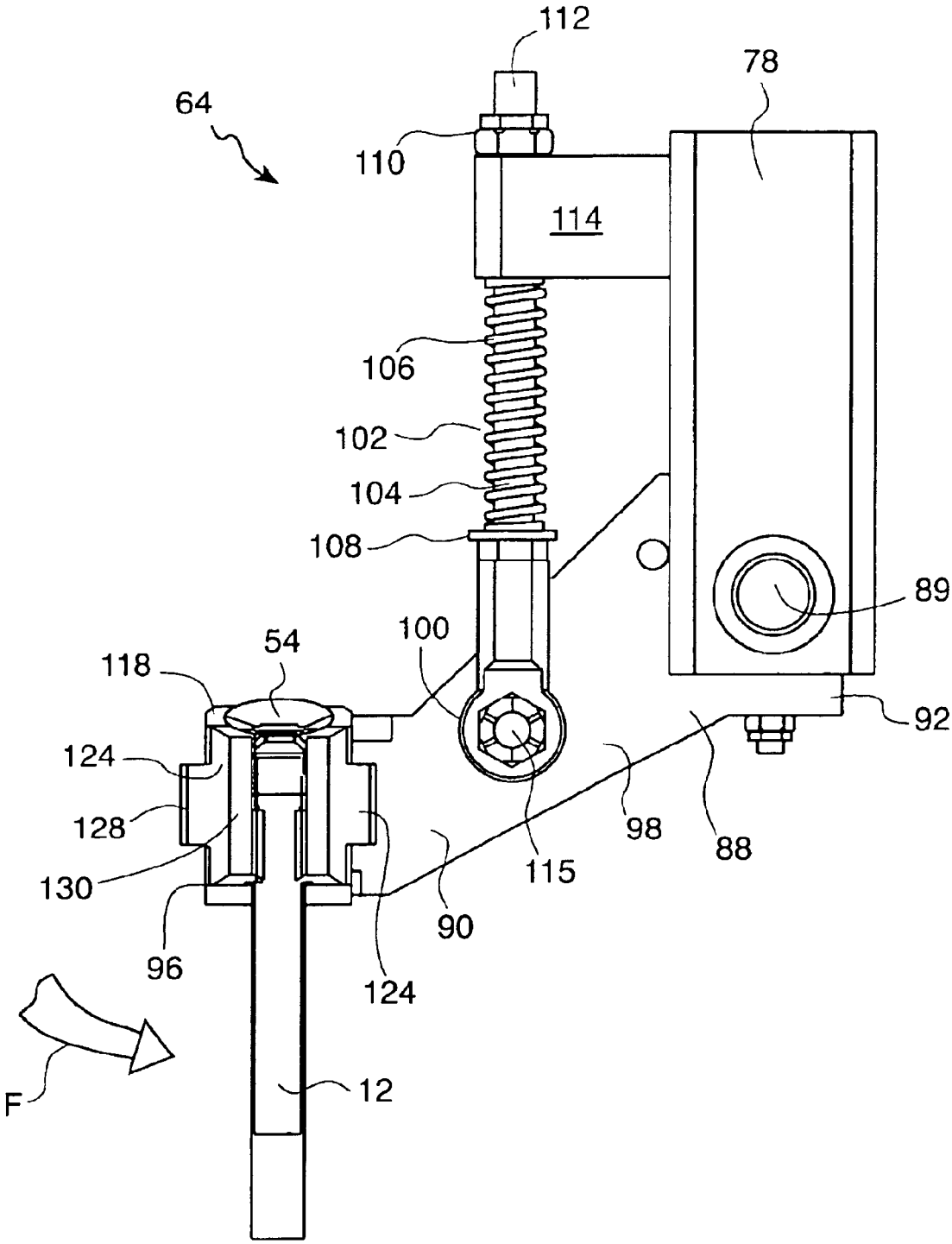
FIG. 6 is an enlarged side view of the jaw mount assembly from the present rail fastener driving apparatus.

Referring now to FIGS. 4 and 6, the fastener holder 64 includes a support block 78 having a generally vertical counterbore 80 for receiving a free end 82 of the shaft 68. The block 78 is fastened to the free end, preferably both by a threaded fastener 84 and a key 86 engaging a keyway (not shown) machined in the end of the shaft 68. Thus, the block 78 does not rotate relative to the shaft 68. A jaw mount support 88 is pivotably secured to the support block 78 to pivot on an axis 89 transverse to the direction of travel of the machine 10 on the track. The jaw mount support 88 preferably has a generally planar body 90 with a first, generally wide end 92 having a pivot bore 94, a second end 96 offset from the first end in a dogleg or offset configuration. A central section 98 is provided with a mounting bore 100 for a spring rod 102, including a shaft 104 circumscribed by a compression spring 106 retained in position by suitable washers 108 and locknuts 110 as is known in the art. An upper end 112 of the spring rod 102 is slidably received in a weidment 114 secured, as by welding or suitable equivalent, to the support block 78. A lower end of the spring rod 102 is engaged on the jaw mount support 88 by a fastener 115 engaging the mounting bore 100. The spring rod 102 is configured to bias the jaw mount support 88 in an operational position (FIG. 6) with the force acting in a direction represented by the arrow F toward the track and in the direction of travel of the machine 10 along the track.

Returning to the jaw mount support 88, the second end 96 is preferably narrower than the first or wider end 92, with the central section 98 tapering therebetween, and the second end is provided with a jaw mount aperture 116 for receiving a jaw mount or jaw mount block 118. The jaw mount 118 has a body 120 having a generally "I"-shape when viewed from the front and provided with first and second sides 122. Each side 122 is configured to receive a corresponding jaw 124 which is pivotally secured to the side via a pivot pin 126 passing through a throughbore 127 approximately centrally located in the jaw and into the jaw mount body 120. The location of the throughbore 127 on the jaw 124 may vary to suit the application. The jaws 124 are preferably "T"-shaped when viewed from the side. Each jaw 124 has a relatively narrow pivot end 128 and a relatively wider free end 130 opposite the pivot end and as such reciprocate laterally on the jaw body 120. At least one jaw spring 132 is connected to the corresponding jaw 124 and to the jaw mount body 120 to bias the jaws to a closed position about a fastener (best seen in FIG. 6). In the preferred embodiment, the jaw spring is a compression type which pushes the pivot ends 128 away from the jaw body 20. Other arrangements are contemplated as are known in the art. It is contemplated that one spring 132 could bias both jaws 124. For preferred operation, the jaws 124 are configured to support the fastener 12 by the head 54 and do not surround the fastener, facilitating the withdrawal of the fastener holder 64 once the ram 44 has at least partially driven the fastener into the tie 14.

Another feature of the present fastener driving unit 40 is that the fastener holder 64 is biased by the spring rod 102, not only in the direction of travel of the machine, but also to the second, or fastener driving position under the ram 44. In this manner, overload or obstacle impact protection is provided by the spring rod biasing force being exerted in a direction transverse to the gripping force exerted by the jaws 124. This obstacle protection feature enables the present fastener feeder mechanism 62 to move between the first and second positions while the machine 10 moves relative to the track. While conventional fastener driving machines required the fastener feeder mechanism and/or the ram 44 to be raised between fastener driving operations as the machine was moved from tie-to-tie, such repeated vertical repositioning lengthens the fastener driving cycle time and reduces the productivity of the machine.

An advantage of the obstacle accommodation feature of the present pivotable jaw mount support 88 is that it reduces the cycle time of the rail fastener driving operation, and enables the practicing of an unconventional sequence of rail fastener driving. Using the above-identified rail fastener apparatus, including the fastener driving units 40 with the fastener holder 64 or their equivalent, the following method of driving rail fasteners 12 into tie plates 16 and ties 14 of a railroad track may be practiced.

As described above, the rail fastener driving apparatus 10 is provided with at least one fastener driving mechanism 40 having a reciprocating element 44 for impacting a fastener and driving it into a tie, a fastener magazine 52 configured for accommodating a plurality of rail fasteners and feeding them sequentially for driving by the element 44 and a fastener feeder mechanism 62 including a fastener holder 64 configured for movement between a first position receiving at least one fastener from the magazine 52 and a second position placing the at least one fastener in a driving position for engagement by the driving element. The fastener holder 64 is pivotally biased relative to the feeder mechanism 62 for accommodating obstacles encountered while traveling along the track in the first position.

Next, a fastener supplied by the magazine 52 to the fastener holder 64 is driven using the driving element 44. Upon the completion of the driving step, the driving element 44 is retracted and the feeder mechanism 62 is moved to the first position. Next, either another fastener is loaded into the fastener holder 64, or the apparatus 10 is moved along the track, followed by the other of loading another fastener into the fastener holder and moving the apparatus along the track. At this point, the fastener holder 64 with a fastener is moved to the second position for engagement by the driving element 44. The movement of the apparatus 10 along the track is stopped, and the operator locates a hole suitable for driving a fastener. Lastly, the operator drives the fastener in the fastener holder into the tie 14 using the driving element 44.

Thus, it will be seen that the present rail fastener driving units provide a relatively reduced fastener driving cycle time which is intended to increase operational efficiency of this rail maintenance operation. In addition, the obstacle accommodation feature reduces the damage incurred by the fastener feeding mechanism when located close to the rail during machine movement.

While a particular embodiment of the present rail fastener driver with enhanced fastener positioning has been described herein, it will be appreciated by those skilled in the art that changes and modifications may be made thereto without departing from the invention in its broader aspects and as set forth in the following claims.

What is claimed is:

1. A rail fastener driver apparatus for driving fasteners into ties of a railroad track, comprising:

a fastener driving mechanism with a reciprocating element for engaging a fastener and driving it into a tie;

a fastener magazine configured for accommodating a plurality of rail fasteners and feeding them sequentially for driving by said element;

a fastener feeder mechanism including a fastener holder configured for movement between a first position sequentially receiving one said fastener from said magazine and a second position placing the fastener in a driving position for engagement by said driving element; and said fastener feeder mechanism configured for lowering and axially rotating said at least one fastener from said first position to said second position.

2. The apparatus of claim 1 in which said fastener feeder mechanism is configured for simultaneously lowering and axially rotating said at least one fastener from said first position to said second position.

3. The apparatus of claim 2 in which said fastener feeder mechanism includes a fluid power cylinder with a grooved shaft configured for rotating while reciprocating.

4. The apparatus of claim 3 wherein said grooved shaft is configured to rotate approximately 90° between a retracted position and an extended position.

5. The apparatus of claim 1 wherein said fastener feeder mechanism is configured for moving between said first and second positions while said apparatus moves relative to the track.

6. The apparatus of claim 5 wherein said apparatus has a direction of travel along the track, and said fastener holder is biased in the direction of travel against obstructions.

7. The apparatus of claim 6 wherein said fastener holder is biased in the direction of travel in said second position.

8. The apparatus of claim 6 wherein said fastener holder includes a jaw mount support pivotable on an axis transverse to the direction of travel and is biased to an operational position.

9. The apparatus of claim 8 wherein said fastener holder further includes a pair of reciprocating fastener holding jaws mounted to said jaw mount support for holding a fastener.

10. The apparatus of claim 6 wherein said fastener holder includes a pair of opposed jaws exerting a gripping force on the fastener, and said fastener holder is biased to said second position against overload protection in a direction transverse to said gripping force.

11. A rail fastener driver apparatus for driving fasteners into ties of a railroad track, comprising:

a frame configured for movement in a specified direction of travel along the track;

a fastener driving mechanism connected to said frame and provided with a reciprocating element for impacting a fastener and driving it into a tie;

a fastener magazine configured for accommodating a plurality of rail fasteners and feeding them sequentially for driving by said element;

a fastener feeder mechanism including a fastener holder configured for movement between a first position receiving a fastener from said magazine and a second position placing the fastener in a driving position for engagement by said driving element;

said fastener holder configured for biased, pivotal movement relative to said feeder mechanism for accommodating obstacles encountered while said frame travels upon the tracks;

said fastener holder includes a jaw mount support pivotable on an axis transverse to the direction of travel and is biased to an operational position; and said fastener holder further includes a pair of reciprocating fastener holding jaws mounted to said jaw mount support for holding a fastener.

12. The apparatus of claim 11 wherein said fastener holder is biased in the direction of travel of said frame along the track.

13. The apparatus of claim 11 wherein said pair of opposed jaws exert a gripping force on the fastener, and said fastener holder is biased to said operational position against overload protection in a direction transverse to said gripping force.

14. A jaw mount suitable for use with a rail fastener driving apparatus with a fastener driving mechanism and provided with a reciprocating element for impacting a fastener and driving it into a tie, a fastener magazine configured for accommodating a plurality of rail fasteners and feeding them sequentially for driving by said element, a fastener feeder mechanism including a fastener holder configured for movement between a first position receiving a fastener from said magazine and a second position placing the fastener in a driving position for engagement by said driving element, said fastener feeder mechanism configured for lowering and axially rotating said at least one fastener from said first position to said second position, comprising:

a generally planar body with a first, generally wide end having a pivot bore, a second end offset from said first end in a dogleg configuration;

a central section provided with a mount for a spring rod;

said second end being narrower than said first end, with said central section tapering therebetween, and said second end provided with a jaw mount aperture;

said body forming a portion of said fastener feeder mechanism and being connectable to a jawblock assembly configured for releasably retaining the fastener during said lowering and said axial rotation.

15. A jawblock assembly for use with a rail fastener driving apparatus with a fastener driving mechanism and provided with a reciprocating element for impacting a fastener and driving it into a tie, a fastener magazine configured for accommodating a plurality of rail fasteners and feeding them sequentially for driving by said element, a fastener feeder mechanism including a fastener holder configured for movement between a first position receiving a fastener from said magazine and a second position placing the fastener in a driving position for engagement by said driving element, said fastener feeder mechanism configured for lowering and axially rotating said at least one fastener from said first position to said second position, comprising:

a main jawblock body forming a portion of said fastener feeder mechanism having a generally "I"-shape when viewed from the front and provided with a first and second side;

a pair of jaws, one configured for attachment at each of said sides and having a pivot end, a vertical through-bore for a pivot pin and a fastener engagement end, said jaws being configured for releasably retaining the rail fastener while secured by said fastener feeder mechanism during said lowering and said axial rotation; and said pivot ends of said jaws being pivotally engaged on said corresponding sides.

16. The jawblock of claim 15 further including at least one spring for biasing said fastener engagement ends together.

17. The jawblock of claim 16 wherein said at least one spring is connected at one end to said jawblock and at an opposite end to said corresponding jaw.

* * * * *